US007533546B2

(12) United States Patent
Stingel

(10) Patent No.: US 7,533,546 B2
(45) Date of Patent: May 19, 2009

(54) SYSTEM COMPONENT FOR A KNITTING SYSTEM AND HANDLING METHOD

(75) Inventor: Uwe Stingel, Messstetten (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 11/700,759

(22) Filed: Feb. 1, 2007

(65) Prior Publication Data

US 2007/0175244 A1 Aug. 2, 2007

(30) Foreign Application Priority Data

Feb. 2, 2006 (EP) ..... 06002102

(51) Int. Cl.
*D04B 15/06* (2006.01)

(52) U.S. Cl. ..... 66/116; 66/104

(58) Field of Classification Search ..... 66/116–124, 66/90, 91, 104, 1 R; 206/380, 382, 383
See application file for complete search history.

(56) References Cited

U.S. PATENT DOCUMENTS

| | | | | |
|---|---|---|---|---|
| 2,944,662 | A * | 7/1960 | Colton | 206/372 |
| 3,004,660 | A * | 10/1961 | Hofmann | 206/382 |
| 3,452,859 | A * | 7/1969 | Hofmann | 206/380 |
| 3,823,581 | A * | 7/1974 | Russo | 66/208 |
| 5,925,841 | A | 7/1999 | Rossum | |
| 5,966,969 | A * | 10/1999 | Mista | 66/206 |
| 6,484,541 | B1 | 11/2002 | Haag | |
| 6,632,317 | B1 | 10/2003 | Höfer | |
| 6,912,875 | B2 * | 7/2005 | Fehrenbacher | 66/1 R |
| 7,055,347 | B2 | 6/2006 | Bruske et al. | |
| 7,070,050 | B2 | 7/2006 | Faller et al. | |
| 2004/0055916 | A1 | 3/2004 | Faller et al. | |
| 2004/0244429 | A1 | 12/2004 | Fehrenbacher | |

FOREIGN PATENT DOCUMENTS

| | | |
|---|---|---|
| DE | 1 103 233 | 3/1961 |
| DE | 36 33 665 A1 | 4/1988 |
| DE | 297 22 285 U1 | 2/1998 |
| DE | 198 54 191 A1 | 5/2000 |
| DE | 199 20 673 A1 | 11/2000 |
| DE | 102 44 315 A1 | 4/2004 |
| DE | 102 27 532 A1 | 5/2004 |
| EP | 1 486 600 A1 | 5/2004 |
| JP | 57177572 | 11/1982 |
| JP | 60-127387 | 8/1985 |
| JP | 2-4137 | 1/1990 |
| JP | 9-256253 | 9/1997 |

* cited by examiner

*Primary Examiner*—Danny Worrell
(74) *Attorney, Agent, or Firm*—Fitch, Even, Tabin & Flannery; Norman N. Kunitz

(57) ABSTRACT

A system component (1), such as, for example a knitting machine needle (2), intended for a loop-forming machine has in its foot (8) at least one cutout (14) that is set up to accommodate a section of a holder (17). This holder can be clipped into the cutout in order to hold several such system components in a pre-specified sequence and at a lateral distance and in alignment with respect to each other. The systems components, which are thus temporarily connected to each other, can be handled as a unit and, in this manner, can be removed from the bed (5), can be treated, for example be cleaned, and can be replaced in the same sequence and alignment in the bed (5).

13 Claims, 5 Drawing Sheets

SYSTEM COMPONENT FOR A KNITTING SYSTEM AND HANDLING METHOD

CROSS REFERENCE TO RELATED APPLICATION

This application claims the priority of European Patent Application No. 06 002 102.9, filed on Feb. 2, 2006, the subject matter of which, in its entirety, is incorporated herein by reference.

BACKGROUND OF THE INVENTION

The invention relates to a system component for a knitting system such as, for example, a knitting machine needle, a selecting element, a sinker, a clutch element or the like.

Such systems are used in large numbers in knitting machines, for example, flat-bed knitting machines or circular knitting machines. These machines have beds, in which guide channels are arranged next to each other for the accommodation of the system components. Referring to flat-bed knitting machines, the guide channels are arranged parallel to each other in a flat bed. This is also true with respect to the knitting cylinders of a circular knitting machine. The bed may also be designed as a dial of a knitting machine or as a sinker ring of a circular knitting machine. In this case, the guide channels are arranged radially, so that adjacent guide channels together subtend an acute angle.

For cleaning of knitting machine needles and/or sinkers, it may be necessary to remove the system components from the machine, i.e., from their respective beds, to perform a cleaning process and then to replace them in their beds. Also, amending the pitch or spacing of the knitting tools of the knitting machine frequently involves the removal of system components, in which case the procedure is similar. The needles or other guide channels adjacent to other system components are aligned with respect to each other by the bed in which they are located. In addition, the system components are arranged in a specific sequence (order). This is of particular importance when different system components are arranged in the successive guide channels. For example, these components may be knitting machine needles with feet arranged in different positions. After the system components have been removed from their bed and are to be reinserted therein, they must be again brought into the desired alignment and into the desired order. If the system components are removed from their bed and mixed, this represents a time-consuming difficult procedure. In addition, system components that are not arranged in an order can be cleaned only with difficulty.

In particular referring to knitting or loop-forming machines, in which many system components are moved in a fully synchronized manner with respect to each other in that they are mounted, for example, to a bar, it has been known to rigidly connect the system components to one another. This has been disclosed by document DE 199 20 673 C2, DE 102 27 532 A1 or by DE 198 54 191 A1. In accordance with these literature references, plastic bodies are used to hold the sinkers or apertured needles in fixed alignment with respect to each other, said bodies being configured as rods or blocks that extend through the openings of the sinkers. Similarly, document U.S. Pat. No. 6,925,841 B2 discloses a module made of several sinkers, in which case the individual sinkers are held in fixed alignment with respect to each other by interposed plates.

Referring to these modules, the permanent fixation of the individual sinkers with respect to each other is of importance.

A change of the pitch or an independent movement of the individual sinkers with respect to each other is not provided here.

Document DE-AS 1 103 233 discloses a package for needles of a Raschel machine. The package contains a soft substance into which the needles can be pressed.

Document DE 102 44 315 is based on a different approach. This document discloses transport packaging for compound needles and a correspondingly configured shipping unit. This transport packaging includes, for example, a bar having a U-shaped cross-section. The two legs of the U-shaped cross-section have slits that are arranged parallel to each other, said slits holding a knitting tool located therein by frictional engagement. The division of the slits of the bar can be adjusted to the division of the guide channels in a knitting cylinder, so that the knitting tools can be transferred easily from the transport bar to the knitting cylinder. However, specific aids for the transfer of needles from the knitting cylinder into the transport package are not provided.

Considering this, it is the object of the invention to improve handling of the system components for a knitting system.

SUMMARY OF THE INVENTION

The above object generally is achieved according to the present invention by an inventive system component that comprises a body which is provided for the accommodation in a guide channel of a loop-forming machine such as, for example, a knitting machine, and further comprises a means for the temporary connection to a holder. This means is provided at a point of the system component, said point being accessible when the system component is seated in the guide channel. This point may be located outside the guide channel or may be located in an interruption of said guide channel.

For example, this means is provided with a projection that has a cutout that serves for the temporary accommodation of a holder. The holder can be inserted in this cutout, and thus holds the system component. The projection, for example, is a foot of the system component, whereby such a foot can be provided for driving said system component by means of a cam box. As a rule, this foot projects from the guide channel of the bed of the loop-forming machine, while the remaining body of the system component is substantially accommodated by the guide channel. Therefore, the foot is accessible, so that the holder can be connected to the projection in a simple manner, while the system component is still located in the guide channel.

However, instead of the foot, it is also possible to use any other projection for the mentioned purpose, in which case the projection can be seamlessly connected in one piece to the body of the knitting machine needle. It is also possible to assign the projection to a part of the knitting machine needle, said part being coupled or connected to the body, but being regarded as a separate part.

Within the framework of the invention, the cutout, which accommodates a holder for temporary connection, can also be located in a region of the system component where no projection is provided. Referring to the location of the cutout in the system component, it is of importance that the cutout be accessible following the installation of the system component in the knitting machine. If the cutout is not located on a projection that projects from the guide channel, said guide channels is provided with cutouts, so that the former cutout is accessible and that a holder can be inserted or removed.

If system components having different geometric shapes are used in a knitting machine, the cutout for the accommodation of the holder is preferably located at the same point on the system components. This means that the distance from a reference edge of the system component, e.g., the hook or the needle end, to the cutout is identical for all system components, so that the cutouts are located in a common plane or on a common straight or slightly curved line. Preferably, the cutouts of adjacent system components are arranged in alignment next to each other.

If the cutout, for example, represents an open-edge cutout that opens into the face side of the foot, a more or less elastic holder can be inserted in said cutout. In so doing, the cutout preferably is provided with a mouth that is slightly narrower than the cutout itself. As a result of this, the holder can be attached to the system component in locking engagement. In particular, this applies when the width of the mouth is 70% to 90% of the width of the cutout. Preferably, the cutout is provided with an edge that follows a curve or a polygon. Also, a polygonal edge may have arcuate corners. A polygonal edge configuration has the advantage that a twisting of the system component relative to the holder is made more difficult.

Preferably, the holder consists of an elastic material or is provided with such a material. For example, the holder may be designed as a rubber cord. This cord consists of an elastomer material, for example, EPDM, or of another suitable elastically deformable material. Advantageously, the rubber cord has a circular cross-section, thus facilitating its insertion in the cutout. In so doing, the cross-section of the holder, specifically the rubber cord, may be greater than the cross-section of the cutout. As a result of this, it is ensured that the system component is supported on the holder such that it cannot be moved in axial direction or be twisted. In order to ensure that the holder is securely mounted, it may be advantageous if said holder has the form of a tube or hose. Then, the holder has an internal hollow space enclosed by an elastic jacket. As a result of this, the differences in diameter between the cutout, the holder receptacle and the outside diameter of the holder can be reliably bridged. The holder must then be appropriately mounted in the cutout and exhibits the necessary elasticity in order to safely hold the system components.

While the holder can preferably be designed as an element to be inserted in the cutout, namely a rubber cord, said element may alternatively also be designed in such a manner that it extends around the affected projection of the system component. In this case, the projection, for example the foot of the system component, preferably has on its edges located in front and in back—viewed in the direction of movement—cutouts, which accommodate parts of the holder, for example, corresponding catch projection. Also, in this case, the system components can be secured in the proper position relative to each other with the aid of a holder, as long as said components are placed in this state in the receptacle, e.g., the needle bed, and are removed from, and are again returned into, said receptacle as a block. When cleaning the system components, the holder holds the respective system components at a distance from each other, so that the cleaning fluids can flow unhindered between the system components. If, after completed cleaning, the needles are reinserted in the receptacle, they are automatically provided with the required alignment and order relative to each other. If the holder is elastic, a division change may also be performed. Preferably, to achieve this, the holder is elastic not only in transverse direction but also in longitudinal direction (referring to a rubber cord, this is the direction of said cord). In so doing, it should be noted that, when the holder is stretched in longitudinal direction, the diameter of the cross-section decreases and, beginning with a specific reduction, again releases the system components.

Additional details of advantageous embodiments of the invention result from the drawings, the description or the subclaims.

The drawings illustrate exemplary embodiments of the invention.

DETAILED DESCRIPTION OF THE DRAWINGS

Figure 1:
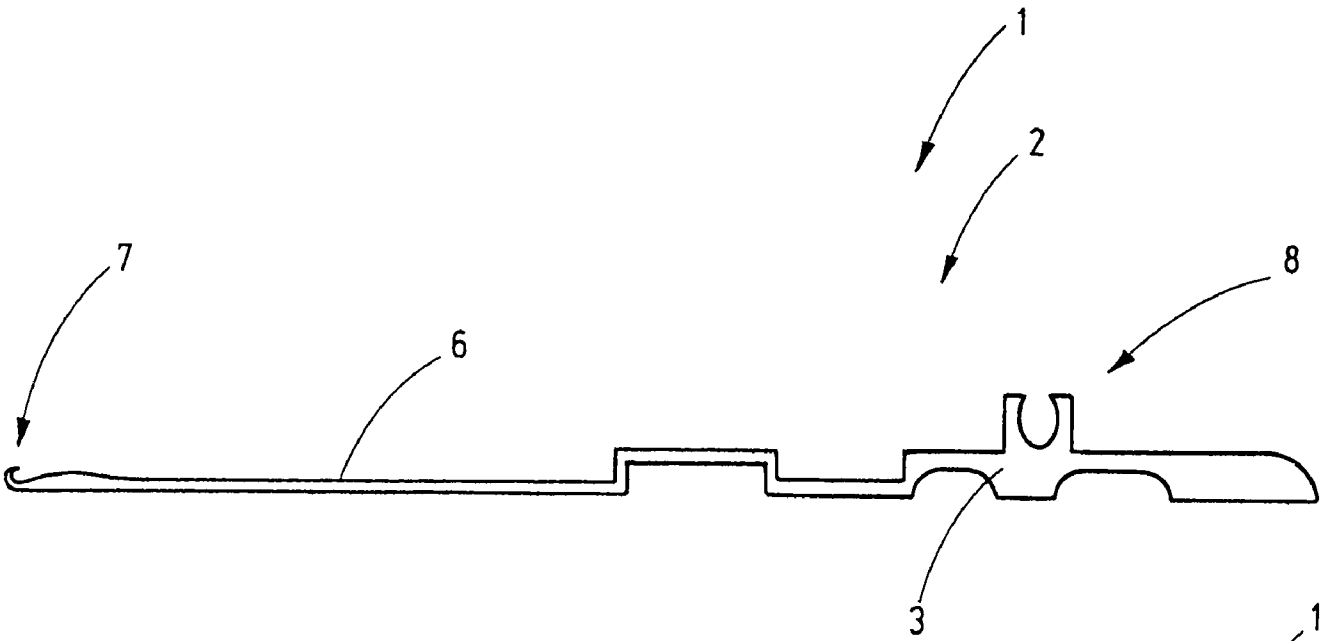
FIG. 1 is a schematic side view of a system component designed as a knitting machine needle.

FIG. 1 illustrates a system component 1 of a loop-forming machine using a knitting machine needle 2 as an example. The knitting machine needle 2 is used only for illustration. The invention can also be implemented with the use of other system components, such as, for example, sinkers, selecting components or the like.

Figure 2:
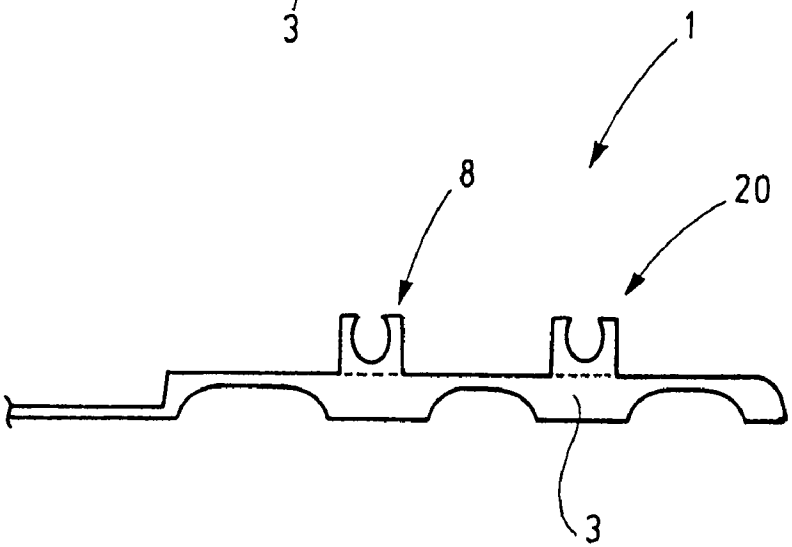
FIG. 2 is a detail of a schematic side view of a modified embodiment of a system component designed as a double-foot knitting machine needle.

The knitting machine needle 2 has a body 3, which, as shown by FIG. 2, is to be placed in a guide channel 4 of a bed 5. The bed 5, for example, is the flat bed of a flat-bed knitting machine, the knitting cylinder of a circular knitting machine or its dial. Said bed has several adjacent guide channels 4, 4*a*, 4*b*, 4*c* etc., in which the bodies 3, 3*a*, 3*b*, 3*c*, etc., of the knitting machine needles 2, 2*a*, 2*b*, 2*c*, etc. are held in such a manner that they can be moved in longitudinal direction.

The body 3 of the knitting machine needle 2 has a shaft 2, and provided on said shaft's end is a hook 7 or another functional section. During operation, the knitting machine needle 2 performs a back-and-forth oscillating movement in longitudinal direction of the shaft. Furthermore, the body 3 has a projection designed as a foot 8, which is operative to perform this longitudinal movement in that said projection is in engagement with the needle race of a cam box. This needle race and the bed 5 move relative to each other, so that the foot 8 slides along the needle race.

Figure 3:
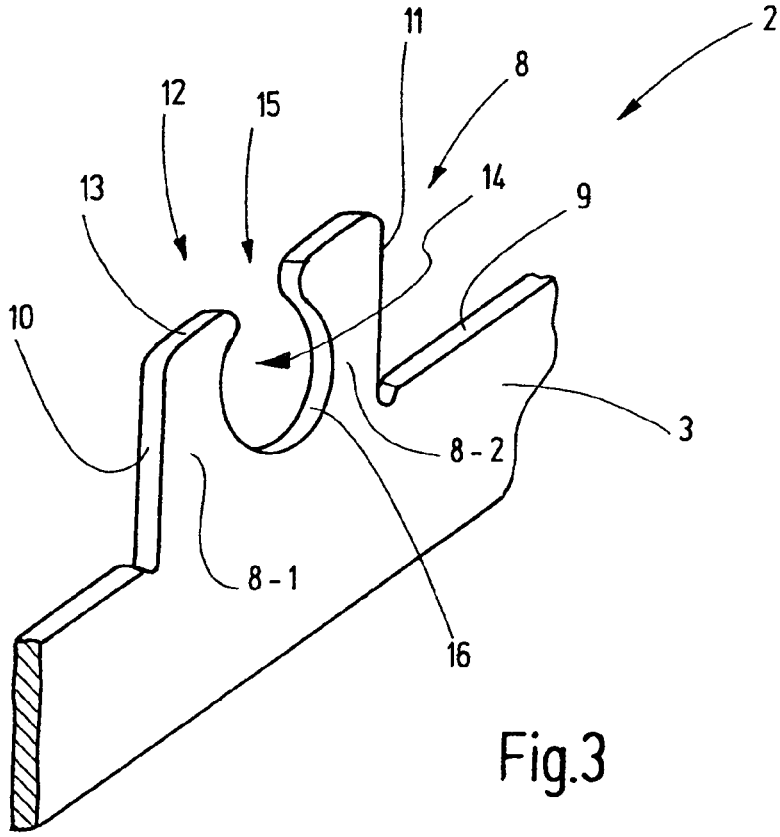
FIG. 3 is a detail of a perspective view, using a different scale, of the knitting machine needle in accordance with FIG. 1.
Figure 5:
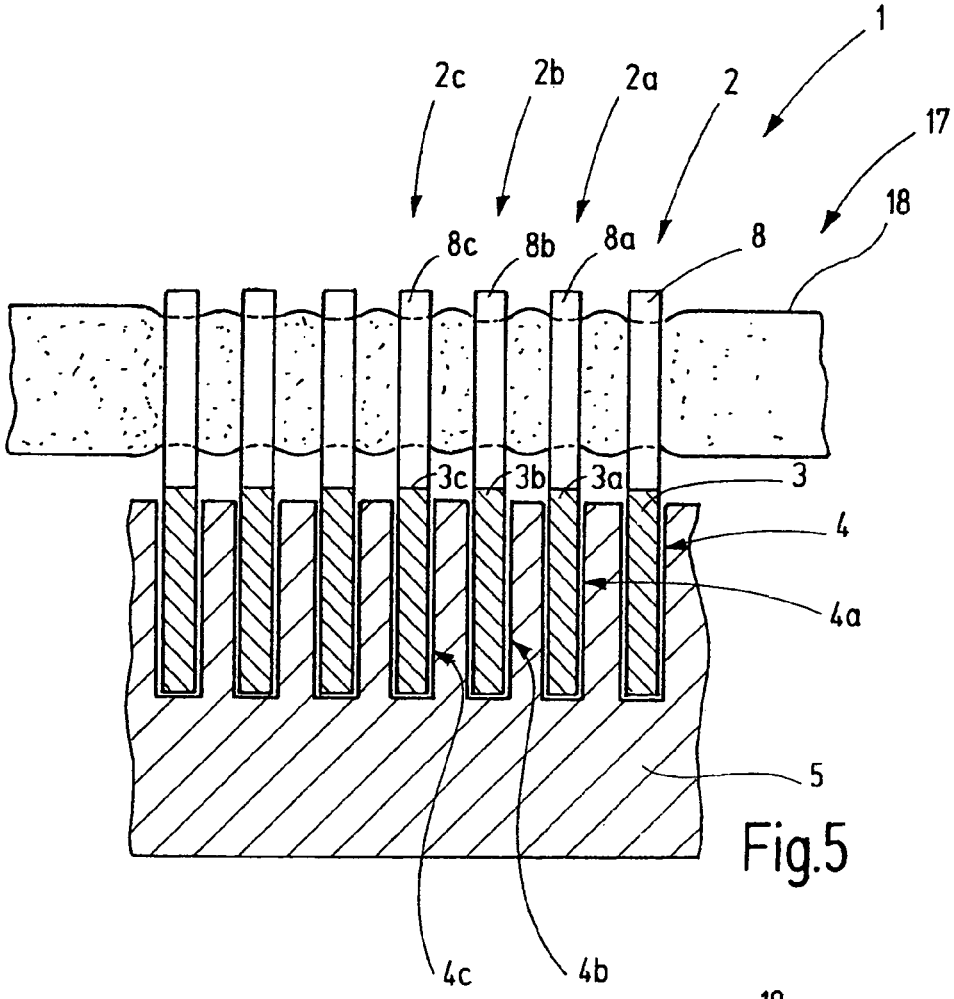
FIG. 5 is a bed of a loop-forming machine with system components and the holder accommodated therein.

As shown by FIG. 5, the foot 8 (8*a*, 8*b*, 8*c*) projects from the respective guide channel 4, 4*a*, 4*b*, 4*c*, whereas the remaining body 3 is accommodated, at least for the most part, by the bed 5. As illustrated by FIG. 1 and, in particular by FIG. 3, the system component or the knitting machine needle 2 is a flat sheet metal part, for example, made of steel. The foot 8 extends away from its narrow side 9. Its thickness mostly corresponds to the thickness of the remaining body 3, which has two flat sides that continuously, and without gaps, become the flat sides of the foot 8.

Preferably, the foot 8 has a substantially rectangular contour with a narrow front and a narrow rear edge 10, 11, respectively, said edges contacting the needle races of the cam box. These needle races extend essentially at a right angle with respect to the narrow side 9. In addition, the foot 8 has a face side 12 with a narrow edge 13. The foot 8 has molded into it a cutout 14, for example, in the form of a circular opening that has on its face side 12 a mouth 15 and is open on its flat sides. The cutout 14 has an edge 16, which preferably is rounded and continuous following an Ω-shape to become the edge 13. Consequently, the edge 16 is arcuate at least in sections. In addition, said edge 16 may have sections that are limited in a straight line, should this be desirable.

Preferably, the mouth 15 is clearly narrower than the width of the cutout 14, said latter width being measured parallel to the edge 13. The width of the mouth 15 that is to be measured in the same direction preferably is in the range of 70% to 90% of the diameter or the width of the cutout 14. In addition, the size of the cutout 14 is such that said cutout does not extend into the region of the body 3. Consequently, the foot 8 has two extensions 8-1, 8-2 that represent the boundaries of the cutout 14 and extend away from the body 3 via which they are connected to each other.

The cutout 14 may be arranged as desired. Based on necessity and on accessibility, said cutout may also be provided at another point of the projection 8. For example, said cutout may be provided on the edges 10, 11.

Figure 4:
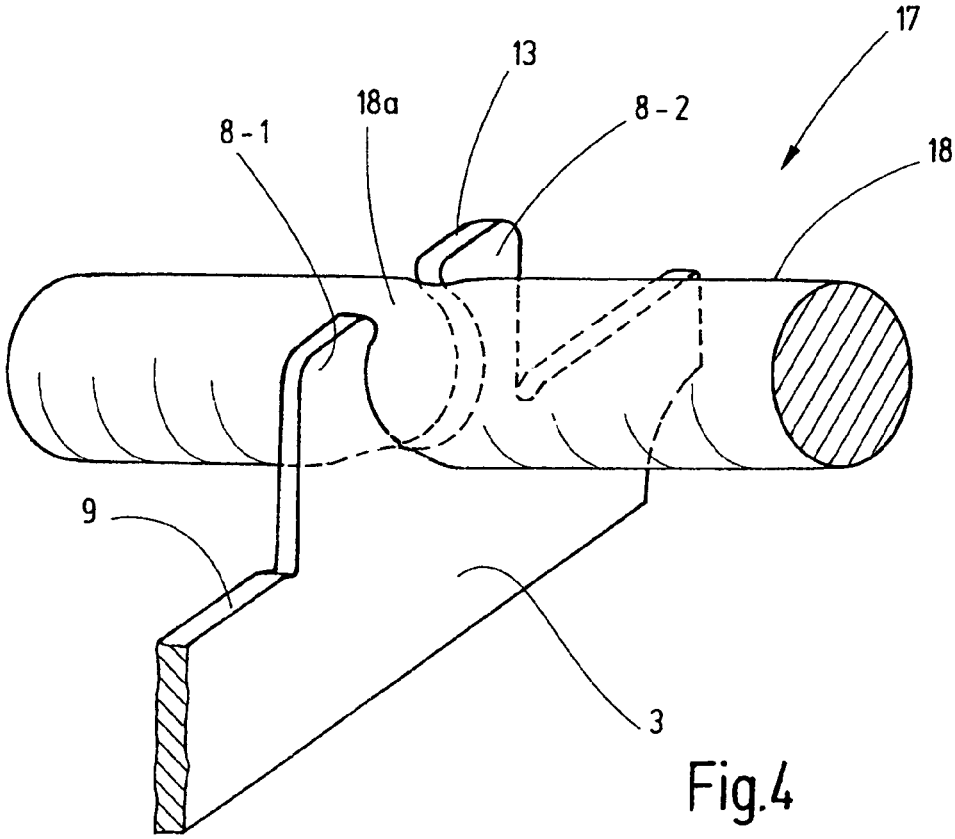
FIG. 4 is the knitting machine in accordance with FIG. 3, with a holder in the form of a rubber cord.

FIG. 4 depicts a holder 17, which is to temporarily support one or more system components. Referring to the illustrated exemplary embodiment, the holder 17 consists of a rubber cord 18, i.e., a (very) narrow cylinder consisting of material that has the elasticity of rubber, such as, for example, EPDM. The longitudinal direction of the cylinder, namely the flexible non-deformed cylinder, represents the longitudinal direction of the cord. The rubber cord 18 preferably has a circular cross-section, in which case the diameter of the cord is preferably greater than the diameter of the cutout 14.

Figure 6:
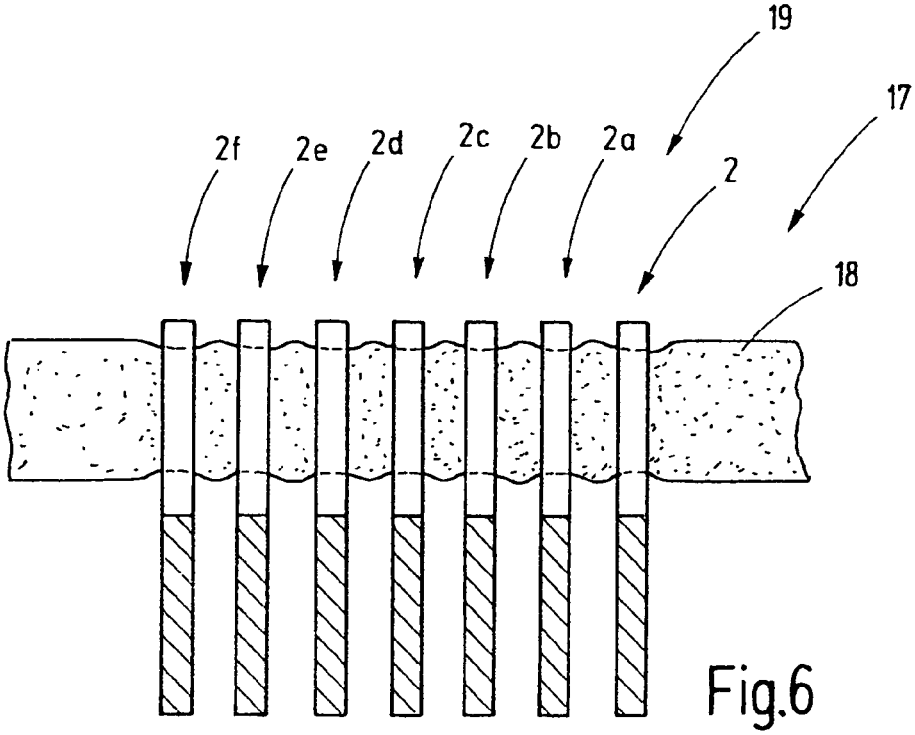
FIG. 6 is the unit formed of the holder and the system components following the removal from the bed in accordance with FIG. 5.

The rubber cord 18 and the system components 2, 2*a*, 2*b*, 2*c*, together, form a set 19, which is illustrated by itself in FIG. 6. As shown, this set may indeed form a flexible but overall handlable, unit, whereby the rubber cord 18 can be separated from the knitting machine needles 2, 2*a* through 2*f* or connected therewith, as needed. In the present example (FIG. 3), the extensions 8-1, 8-2 of the system components 2, 2*a* through 2*f* enclose a disk-shaped section 18*a* of the rubber cord 18, said section being compressed to the smaller diameter of the cutout 14. As is shown by FIG. 6, the material of the rubber cord 18 that has been displaced from the section 18*a* finds room between the system components 2, 2*a* through 2*f*. The system components 2, 2*a* through 2*f* are held on the rubber cord by frictional and positive engagement.

In conjunction with the holder 17, the system components are handled as follows:

When in use, the knitting machine needles 2, 2*a*, 2*b*, 2*c*, etc., are located in the guide channels 4, 4*a*, 4*b*, 4*c* of the bed 5, as shown by FIG. 5. If the system components 2, 2*a*, 2*b*, 2*c* are to be removed and cleaned, for example, the rubber cord 18 may be inserted in the cutouts of the feet 8, 8*a*, 8*b*, 8*c*, etc., in order to do so. To achieve this, said cord is pressed through the mouths 15, in which case said cord is compressed in an elastic manner and partially relaxes again the in the cutout 14. Due to the diameter of this cord, this diameter exceeding the diameter of the cutout 14, said cord is seated in a pre-tensioned manner in the cutout 14. The edge 16 is in frictional engagement with the rubber cord 18. The system components 2, 2*a*, 2*b*, 2*c*, etc., that are connected to the rubber cord 18 can now be removed—together with the rubber cord 18—from the bed 5, in which case said components are held by the rubber cord 18 (or by another holder 17) at the distance from each other, said distance being consistent with the division of the bed 5, and are held in the given sequence (order). FIG. 6 shows the set 19 that has been removed from the bed 5. As is obvious, the cleaning fluids can penetrate between the individual knitting machine needles 2, 2*a*, 2*b*, 2*c*, etc., through 2*f*.

Once cleaning has been completed, the knitting machine needles 2 through 2*f* can again be inserted in the bed 5. Thereafter, the rubber cord 18 can be removed. In so doing, the knitting machine needles 2 through 2*f* are operative again. The original sequence remains unchanged, i.e., regardless of whether only a single type of system components 2, 2*a*, 2*b*, 2*c* or different system components are installed in the entire knitting machine.

Among each other, the knitting machine needles 2 through 2*f* may have a completely identical design. However, this is not absolutely necessary. As mentioned, it is also possible to provide different knitting machine needles, which, for example, have different foot positions. Referring a fully loaded operative knitting machine, the differently designed knitting machine needles then are necessarily placed in a specific pre-specified sequence. This sequence or "order" must be maintained when the knitting needles are removed from and are reinserted in the bed 5. The holder 17 ensures that the sequence or "order" of the knitting machine needles is maintained if they are removed from and are reinserted in the bed 5 with the aid of said holder.

In order to illustrate needles having several feet or different foot positions, reference is made to FIG. 2, which depicts a knitting machine needle with two feet 8, 20, which, among each other, have a completely identical design, which may, however, be arranged in various axial positions. For example, the feet 8, 20 may adjoin the body 3 via nominal break lines, whereby, due to the removal of one or the other foot, the respective system component can be customized. The thusly customized system components, meaning that in some the feet 8 and in others the feet 20 have been removed, are thus held in various axial positions when the rubber cord 18 is inserted, whereby the adjacent feet are still in alignment with each other. The rubber cord 18 ensures that this alignment is maintained, even if the set 19 is handled outside the bed 5.

Figure 7:
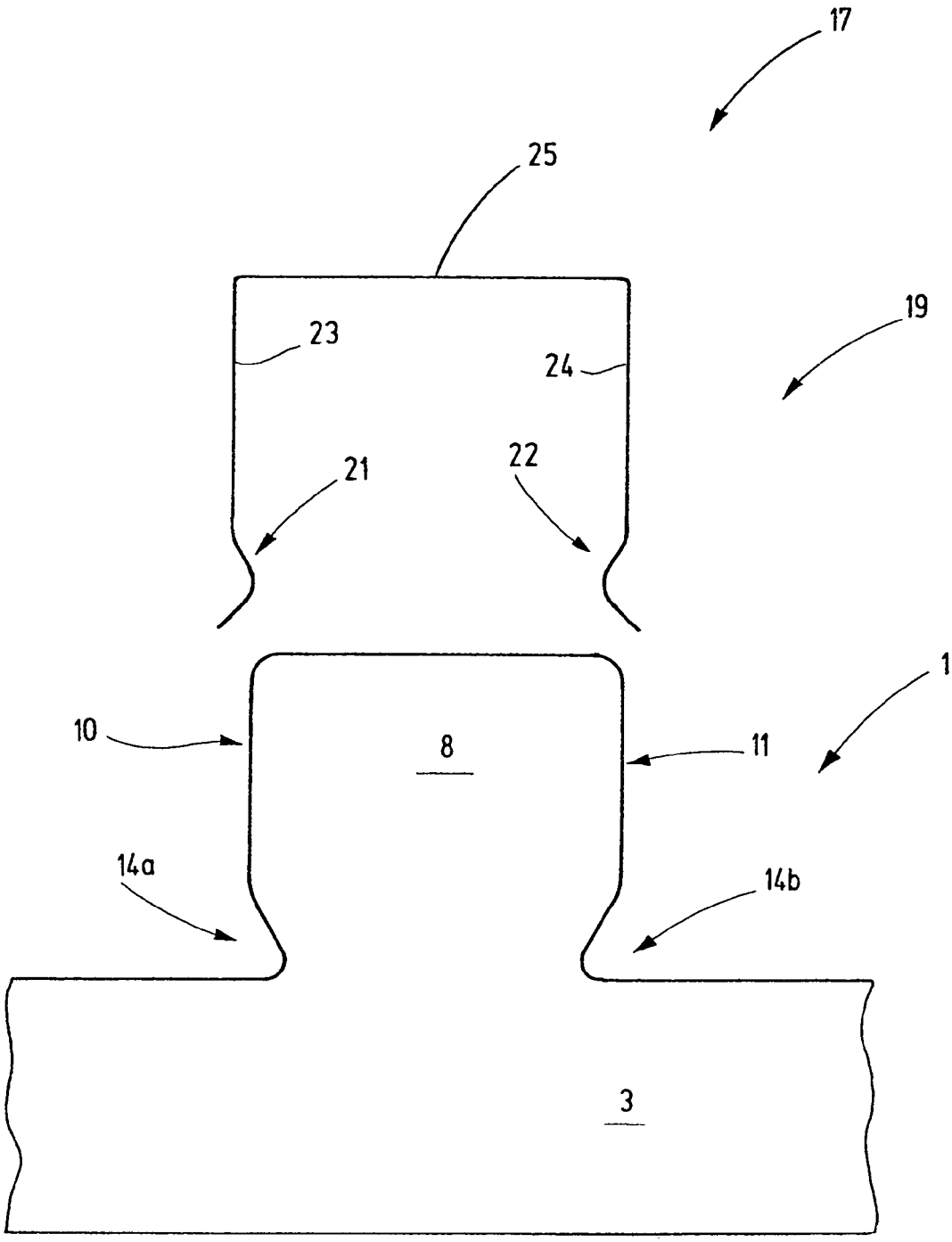
FIG. 7 is a schematic side view of a detail of another embodiment of a system component with a holder.

FIG. 7 shows a modified embodiment of a system component 1 and an associate holder 17. The system component 1, as explained above, has a foot 8 that extends away from the body 3. The foot 8 has at least one, preferably two, cutouts 14*a*, 14*b*, which are provided on said foot's front edge 10 or on its rear edge 11. These cutouts act as engagement cutouts for the accommodation of sections 21, 22 of the holder 7, which otherwise has the configuration of a U-shaped engagement profile that, for example, consists of a plastic material or of thin steel. Said holder has a cross-section that is adapted to the contour of the foot 8, in which case said foot's extensions 23, 24, said extensions being connected to each other via a back section 25, can move toward each other or away from each other in a spring-biased manner. The sections 21, 22 form projections, which somewhat constrict the internal space enclosed by the extensions 23, 24 and the back section 25 and which fit into the cutouts 14*a*, 14*b*. If the cutouts 14*a*, 14*b* are arranged below an edge 30 of a strip 26 of the needle bed 5 (FIG. 9), the holder 17 has cutouts in the region of the strips 26. In so doing, said holder is configured in the manner of a comb (not illustrated), whereby its teeth extend into the cutouts 14*a*, 14*b*.

Referring to the holder 17 in accordance with FIG. 7, several system components 1, having the same contours and being arranged next to each other, and are to be kept in alignment at a distance from each other. Again, a set 19 that can be handled as a unit is formed.

Figure 8:
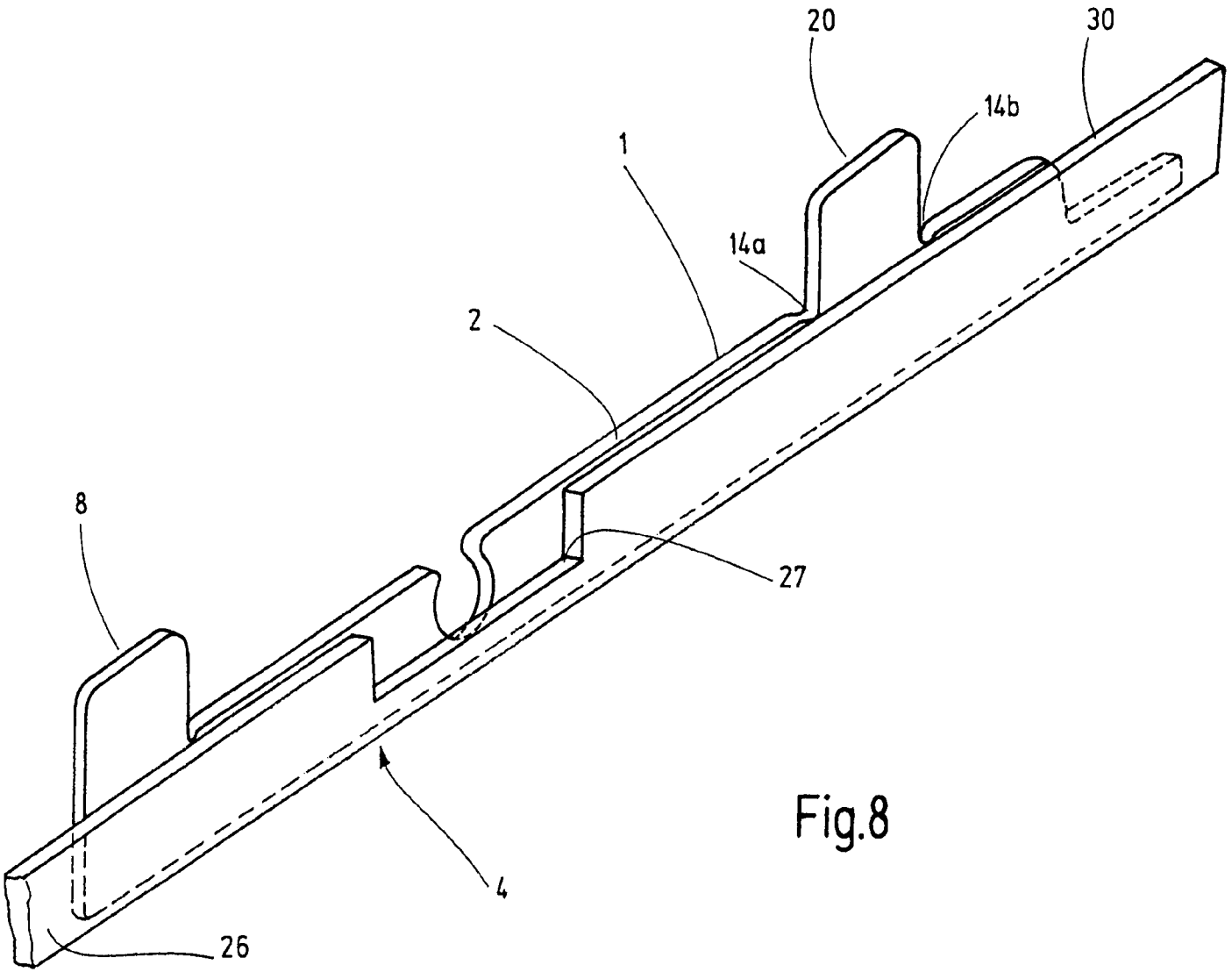
FIG. 8 is a schematic side view of a detail of a system component having a cutout for the accommodation of the holder in the shaft region of the system component.

FIG. 8 shows another exemplary embodiment. In so doing, a system component 1 having the design of a knitting machine needle 2 has two projections 8 and 20 configured as needle feet. The cutout 28 substantially corresponds to the cutout 14, and, therefore, the above descriptions of the cutout 14, as well as of the cutout 28, are applicable. The cutout 28 is arranged in a region of the knitting machine needle 2, this region being associated with the shaft of said needle. Inasmuch as, in this region, the shaft does not project beyond the edge 30 of the strip 26 of the guide channel 4 of the needle bed 5, the strip 26 is exposed in the region of the cutout 28. To do so, the strip 26 has a cutout 27. Consequently, it is possible to insert the rubber cord 18 in the cutout 28 and to remove the system components 1 in an ordered manner from the needle bed 5 of the knitting machine.

A system component, such as, for example, a knitting machine needle 2, for a loop-forming machine has a cutout 14, which is designed to accommodate a section of a holder 17. This holder can be clipped into the cutout in order to hold several such system components in a pre-specified sequence and at a lateral distance and in alignment with respect to each other. The systems components, which are thus temporarily connected to each other, can be handled as a unit and, in this manner, can be removed from the bed 5, can be treated, for example be cleaned, and can be replaced in the same sequence and alignment in the bed 5.

It will be appreciated that the above description of the present invention is susceptible to various modifications, changes and adaptations, and the same are intended to be comprehended within the meaning and range of equivalents of the appended claims.

LIST OF REFERENCE NUMBERS

| | |
|---|---|
| 1 | System component |
| 2, 2a, 2b, 2c, 2d, 2e, 2f | Knitting machine needle |
| 3, 3a, 3b, 3c | Body |
| 4, 4a, 4b, 4c | Führungskanal |
| 5 | Bed |
| 6 | Shaft |
| 7 | Hook |
| 8, 8a, 8b, 8c | Foot |
| 9 | Narrow side |
| 10, 11 | Edge |
| 12 | Face side |
| 13 | Edge |
| 14 | Cutout |
| 15 | Mouth |
| 16 | Edge |
| 8-1, 8-2 | Extensions |
| 18 | Rubber cord |
| 18a | Section |
| 17 | Holder |
| 19 | Set |
| 20 | Foot |
| 21, 22 | Sections |
| 23, 24 | Extensions |
| 25 | Back section |

The invention claimed is:

1. Method for handling system components of a knitting system, wherein the system components each comprise a body that is intended for accommodation in a guide channel of a loop-forming machine, and has at least one open edge cutout formed in an edge of the body for temporarily connecting the body with at least one section of a holder that is an element made of an elastic material and has a cross-section that is greater than that of the cutout, said method comprising:

temporarily connecting the system components—while they are in a bed—to each other for handling by inserting the holder into the respective cutouts of the components;

removing the connected system components in this configuration from the bed and subsequently reinserting the configuration of system components into the bed; and removing the holder once the system components have been reinserted in their bed.

2. Method in accordance with claim 1 for handling the system components of a knitting system, including elastically deforming the holder for insertion in the cutouts of the system components.

3. System component for a knitting system, comprising:

a body that is intended for accommodation in a guide channel of a loop-forming machine, and having at least one means for temporarily connecting the body with at least one section of a holder, wherein the means for temporarily connecting is a open edge cutout formed in an edge of the body; and wherein the holder is an element made of an elastic material and has a cross-section that is greater than that of the cutout but which can fit within the cutout when elastically deformed.

4. System component in accordance with claim 3, wherein the body has a projection, on which the cutout is arranged.

5. System component in accordance with claim 4, wherein the projection is a foot.

6. System component in accordance with claim 4, wherein the foot is provided for driving the system component by a cam box.

7. System component in accordance with claim 3, wherein the open-edge cutout has a mouth having a width that is smaller than a diameter of the holder.

8. System component in accordance with claim 3, wherein the open-edge cutout has a mouth having a width that is smaller than a width of the cutout.

9. System component in accordance with claim 8, wherein the width of the mouth is 70% to 90% of the width of the cutout.

10. System component in accordance with claim 3, wherein the cutout has an edge that follows an arc.

11. System component in accordance with claim 3, wherein the holder is a rubber cord.

12. System component in accordance with claim 3, wherein the holder has a round cross-section.

13. Set consisting of at least one system component in accordance with claim 3 and of the holder assigned to said system component.

* * * * *